United States Patent [19]

Miceli

[11] Patent Number: 4,722,140

[45] Date of Patent: Feb. 2, 1988

[54] KNIFE SYSTEM

[76] Inventor: Philip V. Miceli, 1900 Shanklin Ave., Baltimore, Md. 21234

[21] Appl. No.: 14,115

[22] Filed: Feb. 4, 1987

Related U.S. Application Data

[63] Continuation of Ser. No. 821,346, Jan. 22, 1986, abandoned.

[51] Int. Cl.[4] ..... B26B 11/00; B26B 3/06

[52] U.S. Cl. ..... 30/153; 7/158

[58] Field of Search ..... 30/153, 155, 143, 340; 7/119, 158

[56] References Cited

U.S. PATENT DOCUMENTS

| | | | |
|---|---|---|---|
| 3,363,315 | 1/1968 | Anderson | 30/155 X |
| 4,287,623 | 9/1981 | Tarran | 7/158 |
| 4,364,174 | 12/1982 | De Asis | 30/153 |
| 4,555,822 | 12/1985 | Miceli | 7/119 |

*Primary Examiner*—E. R. Kazenske
*Assistant Examiner*—Michael D. Folkerts
*Attorney, Agent, or Firm*—John F. McClelland, Sr.

[57] ABSTRACT

An improved knife system provides for construction of wear-resistant precise coaxial alignment of pivots connecting "U"-section handle pairs to blade such that a recess in the blade can coact with a handle edge in heavy duty wirestripping without loosening the blade-to-handle pivots. In folding each of the "U"-shaped handles during construction the usual slight misalignments of blade-pivot holes in the two legs of the "U"-section of the handle caused by walking of the tapered handle blank being folded about a centerline between the blade-pivot holes, are avoided. First and second sets of holes are punched in spaced relation along the centerline at the same time as the blade pivot holes cause the handle bending to be precisely symmetrical about the centerline. The sets of holes also serve as drainage holes and provide non-slip grip for the user's hand as well as serving as plier-jaw grips, when desired, as well as providing for wirestripping to be the same in either direction, termed "symmetrical wirestripping".

4 Claims, 13 Drawing Figures

KNIFE SYSTEM

This application is a continuation of applicant's U.S. patent application Ser. No. 821,346, filed 1-22-86 for IMPROVED KNIFE SYSTEM, now abandoned.

FIELD OF THE INVENTION

This invention relates generally to cutting tools and particularly to knives having paired handles that are pivotal to expose and to cover a blade and that coact in additional ways with the blade.

BACKGROUND OF THE INVENTION

My aforementioned applications disclose knives of the type described above.

U.S. Ser. No. 479,841 filed 8-23-83 for FOLDING POCKET TOOL AND KNIFE discloses spanner wrenching slot, screwdriver blade, wire cutting hole, plier and special holding provision;

U.S. Ser. No. 624,022 filed 6-25-84 for POCKET FOLDING TOOL AND KNIFE SYSTEM discloses special clip on plier jaws, a liner-free handle and a "T"-handle facility with storage;

Ser. No. 671,248 filed 11-14-84 for KNIFE SYSTEM WITH REMOVABLE ACCESSORY HANDLE LOCK discloses a separable means for locking tother handles (now U.S. Pat. No. 4,555,822 issued 12-3-85).

In addition, U.S. Pat. No. 4,364,174 issued to L. DeAsis on 12-21-84 for Apparatus and Improved Method of Manufacturing Handles for Butterfly Defense Knife disclosed blade 80 that has on either side at the butt end a guard, and a tang at the butt end, 82, 84, 86, FIG. 7, for example.

U.S. Pat. No. 4,287,623 issued to Phil K. Tarran on 9-8-1981 for EMERGENCY RESCUE AXE DEVICE disclosed a fire hose clamp on pivoted jaws.

U.S. Design Pat. No. 280,179 issued to the present inventor on 8-20-85 for FOLDING KNIFE showed a knife with paired handles that swivel to cover and to expose the blade.

SUMMARY OF THE INVENTION

Principal objects of this invention are to provide an improved knife system that is at the same time easier to make and more precise, and wear resistant under heavy loads, such as heavy wirestripping, for which it is fitted.

Further objects are to provide a system as described that, when the knife blade is used as a screwdriver, is less likely to slip from a user's hand, that can be used as a plier with slip-resistant jaws, and that has free-draining handles, and is attractive in appearance.

In brief summary given for cursive descriptive purposes only and not as limitation, an improved knife system provides for construction of wear-resistant precise coaxial alignment of pivots connecting "U"-section handle pairs to blade such that in a preferred embodiment a recess in the blade can coact with a handle edge in heavy duty wirestripping without loosening the blade-to-handle pivots, and with the same stripping function in both directions. For this a double bevel on a blade portion is used. A single bevel and a straight (unbevelled) blade portion are provided in other embodiments.

In folding the "U"-section handles the usual slight misalignment of blade-pivot holes in the two legs of the "U"-section of the handle caused by walking of the tapered handle-blank being folded about a centerline between the blade-pivot holes, is avoided.

First and second sets of holes are punched in spaced relation along the centerline at the same time as the blade pivot holes cause the handle bending to be precisely summetrical about the centerline. These holes are through each handle along the centerline or axis of bend. They extend parallel to each other and transverse to the axis in a plane symmetrically between the arms of the "U"-section. The sets of holes also serve as drainage holes and provide non-slip grip for the user's hand as well as serving as plier-jaw grips, when desired.

The above and other objects and advantages of this invention will become more readily apparent on examination of the following description, including the drawings in which like reference numerals refer to like parts.

FIG. 1 is a face view of a knife handle blank to be formed into "U"-section shape;

FIG. 1*a* is an end view of the blank after forming showing old-art imperfection of forming;

FIG. 2 is a face view of a knife handle blank prepared in accordance with a provision of the invention for forming into "U"-section shape;

FIG. 2*a* is an end view of the blank of FIG. 2 after forming into "U"-shape in accordance with this invention;

DETAILED DESCRIPTION

Figure 1:
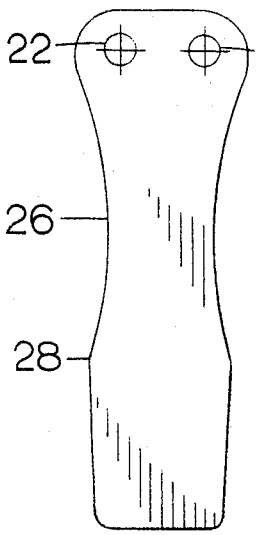

FIG. 1 shows a knife handle blank 20 with at one end a pair of holes 22, 24 for mounting a blade pivot such as a rivet or a threaded post when the blank is folded into a "U"-section. The blank has a tapered shape, with a narrowest intermediate portion at 26 and a widest intermediate portion at 28. The blank may be of the size and proportions shown, and of 0.093 inch (2.2 mm) thick stainless steel, with 0.187 inch (0.5 cm) diameter pivot-mounting holes 22, 24.

Figure 1A:
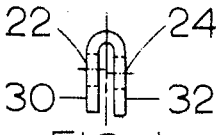
FIG. 1a PRIOR ART

FIG. 1*a* shows the handle blank 20 after it is folded into a "U"-section. Perhaps in part because of the tapered shape, the "U"-section is often imperfect. Without extreme care, it will be assymetrical, leg 30 being longer than leg 32 and the pivot mounting holes 22, 24 out of coaxiality. This can make wire stripping different in one direction from that in the other.

Such misalignment can also cause damage to the pivot structure on assembly, and wear and loosening at the pivot under heavy loads, as when wire is stripped by a blade and handle coacting provision to be described.

Figure 2:
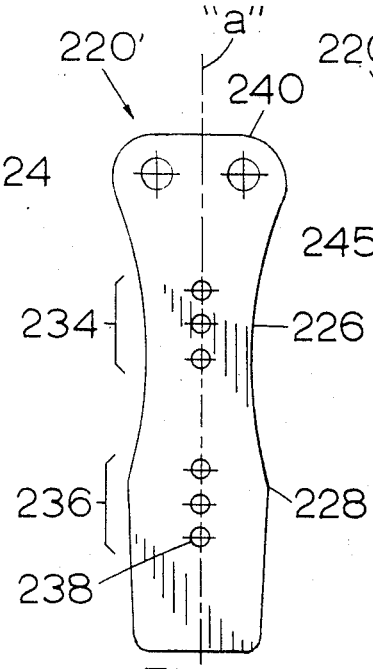

FIG. 2 shows a provision according to this invention that prevents the misalignment errors and problems described, by making symmetrical folding about the long centerline easy, quick and certain, without need for excessive care.

First and second sets 234, 236 of holes 238 are punched along the long axis "a" of the handle blank 220', preferably at the same time that the pivot mounting holes are punched. The operation can include stamping out the handle.

The two sets 234, 236 of holes preferably number three holes each and respectively lie along the axis "a" at the narrowest intermediate portion 226 and at the widest intermediate portion 228 of the blank. Each set spans about onetenth the length of the tapered blank and they are longitudinally spaced apart about the same distance. The hole spacings have about one hole diameter between the holes. The distance between the closer set 234 and the adjacent end 240 of the blank is preferably about 1 inch (2.5 cm).

Figure 2A:
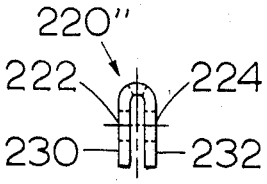

FIG. 2*a* shows the result

When the handle is formed into "U"-shape, as at 220", the two legs 230, 232 are of equal length and the pivot mounting holes 222, 224 are coaxial.

Figure 3:
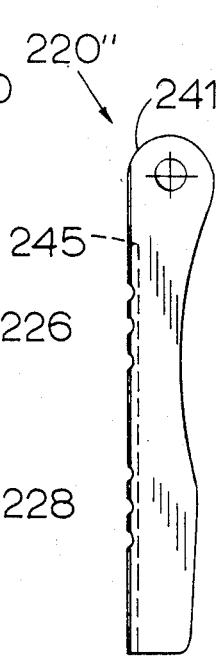
FIG. 3 is a view showing one face of the FIG. 2 blank after folding in accordance with this invention.

FIG. 3 shows the face view of a handle 220" after it is fully formed. Rounding off the handle and slotting as at 241 and 245 forms a recess for pivotal clearance and blade support.

Figure 4:
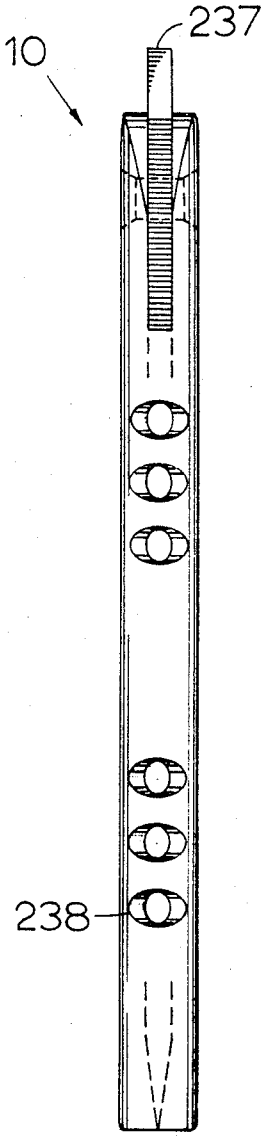
FIG. 4 is an edge view on a larger scale of a knife system made in accordance with this invention.

FIG. 4 shows in enlarged edge-detail of a knife system 10 the attractive appearance of the cross-ellipse shapeof each hole 238. The butt end of the blade at 237 serves as a screwdriver.

Figure 5:
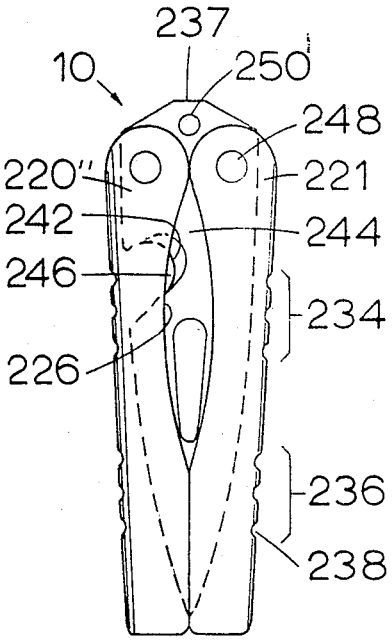
FIG. 5 is a face view of a knife system made in accordance with this invention, in folded mode.

FIG. 5 shows the face view of a knife system 10. Arcuate cutout 242 in the blade 244 coacts with one of the handles 220" to form a convenient heavy duty wirestripper. In this embodiment a double bevel forms sharp arc 242. A narrowest portion 226 exposes the arc 242 adjustably.

A length of insulated wire clasped in the opening 246 can be rotated to cut a ring around the insulation and can be pulled in either direction, because of the bevel on each side, to strip it, while the handles 220", 221 are squeezed together to fit the wire. The sets 234, 236 of holes 238 provide a non-slip grip. Rivets 248 or other suitable pivots fit securely and prevent loosening of the handles from wirestripping or from use of the blade butt as a screwdriver. (Hole 250 in the blade can be used for hanging and blade butt 237 can, as noted, be used as a screwdriver.)

Symmetry of the handles and blade overall shape is desirable.

Wire stripping that is the same in both directions of pulling insulated wire through the cutout may be called symmetrical stripping. Opening 246 may be used as a bottle opener.

Figure 6:
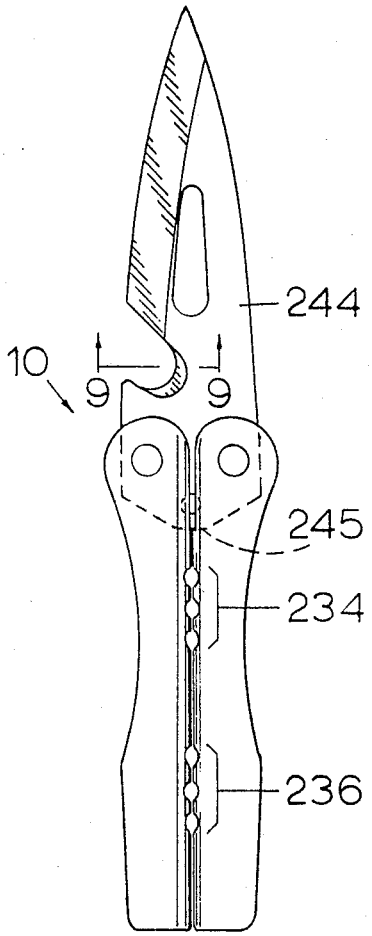
FIG. 6 is a face view of a knife made in accordance with this invention, in blade-deployed mode.

FIG. 6 shows the knife system 10 with the blade 244 deployed for use. In this mode the sets 234, 236 of holes provide for slip-resistant grip of objects held between the handle knives, as in pliers. At 245 the handles support the blade on shoulders.

Figure 7:
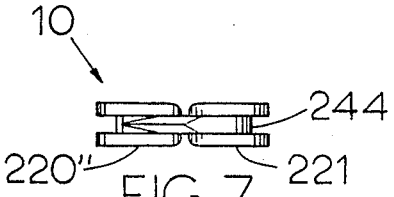
FIG. 7 is an end view of the FIG. 6 showing.

FIG. 7 shows in end-view deployed mode of embodiment 10 how the "U"-section shape of the handles 220", 221 fits the blade 244 and supports it.

Figure 8:
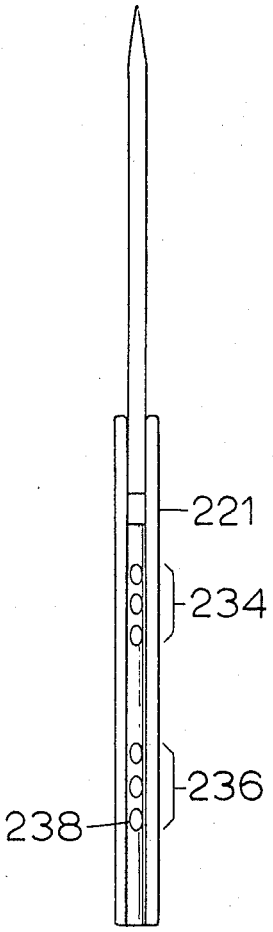
FIG. 8 is an edge view of the FIG. 6 showing.

FIG. 8 shows an edge view how the sets 234, 236 of holes ventilate the handles 221 shown, and provide for cleaning them easier.

Figure 9:
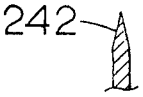
FIG. 9 is an enlarged fragmentary sectional detail taken at 9—9, FIG. 6, of a preferred embodiment.

FIG. 9 shows double bevel edge 242 in fragmentary view taken at 9—9, FIG. 6. This is preferred for symmetrical stripping.

Figure 10:
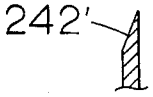
FIG. 10 is a similar view of a further embodiment fragmentary detail.

FIG. 10 shows in a similar detail to FIG. 9 a single bevel 242' that could be employed, but that is not preferred.

Figure 11:
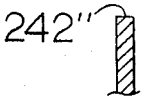
FIG. 11 is a similar view of yet a further embodiment.

FIG. 11 shows in a similar detail to FIG. 9, not a bevel but a square-across section 242" that could be employed, but that is not preferred.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters patent is:

1. In a knife system of the type having a blade, paired handles, each handle formed from planar handle blank bent as a "U"-section about an axis and having arms disposed about said axis, a respective pivoting connection between the blade and each of the paired handles for covering the blade by pivoting the paired handles to a position over the blade and for exposing the blade by pivoting the paired handles from said position over the blade in selected positions of pivoting, the improvement comprising: each of the paired handles having a narrowest portion formed by a concavely curved portion located along the longitudinal edge of said arms opposite said axis, the blade having wirestripping means in the form of an arc-shaped cutout structure which is adjustably covered by said narrowest portion on pivoting of the handles to a blade-covering position, and means providing for symmetry in said "U"-section on forming said "U"-section, comprising structure defining a plurality of drainage holes through each handle along said axis, said drainage holes extending parallel to each other and transverse to said axis in a plane symmetrically between the arms of said "U"-section.

2. In a knife as recited in claim 1, said plurality of drainage holes comprising two sets of holes of uniform size.

3. A knife system of the type having a blade, paired handles each formed from a planar handle blank bent as a "U"-section about an axis, a respective pivoting means connection between one end of the blade and an end of each of the paired handles for covering opposite edges of the blade by pivoting the paired handles to a first position over the blade and for exposing the blade by pivoting the paired handles to a second position away from the blade, the improvement comprising: each "U"-section having a pair of arms parallel to each other each of the paired handles having means for providing a non-slip grip and for drainage of said "U"-section, in the form of structure defining a plurality of drainage holes extending through the handle symmetrically between the arms of the "U"-section along and transverse to said axis, and parallel to each other, such that said holes are located to facilitate the bending of said planar handle blank symmetrically about said axis.

4. A knife as recited in claim 3, said plurality of holes being two sets of holes of uniform size.

* * * * *